United States Patent [19]

Abe

[11] Patent Number: 4,570,779

[45] Date of Patent: Feb. 18, 1986

[54] COIN SORTING DEVICE

[75] Inventor: Hiroshi Abe, Kodaira, Japan

[73] Assignee: Asahi Seiko Kabushiki Kaisha, Tokyo, Japan

[21] Appl. No.: 490,338

[22] Filed: May 2, 1983

[30] Foreign Application Priority Data

May 11, 1982 [JP] Japan ..... 57-77582

[51] Int. Cl.[4] ..... G07D 5/08

[52] U.S. Cl. ..... 194/318; 194/344

[58] Field of Search ..... 194/99, 100 R, 100 A, 194/1 C, 1 D, 1 K, DIG. 29

[56] References Cited

U.S. PATENT DOCUMENTS

| | | | |
|---|---|---|---|
| 4,257,512 | 3/1981 | Hooker | 194/100 A |
| 4,376,480 | 3/1983 | Abe | 194/101 |
| 4,398,626 | 8/1983 | Barnes | 194/100 R X |

FOREIGN PATENT DOCUMENTS

| | | | |
|---|---|---|---|
| 46-16527 | 5/1971 | Japan . | |
| 925094 | 5/1963 | United Kingdom | 194/100 R |

*Primary Examiner*—F. J. Bartuska

*Attorney, Agent, or Firm*—Parkhurst & Oliff

[57] ABSTRACT

A coin sorting device is disclosed having a coin sorting passage defined between a stationary side plate and a movable side plate openably connected at the upper side thereof to and spaced sidewardly from the stationary side plate, the coin sorting passage is provided with a track movable sidewardly to open the passage downwardly. There is at least one set of coin material detector coils including transmitting and receiving coils positioned in alignment with each other at the opposite sides of the coin sorting passage, respectively for detecting a load impedance of a coin running on the track. Both of the transmitting coils and the receiving coils are opposedly fixed in a stationary retainer fixed in predetermined position relative to the track. This track is adapted for retracting out of the coin sorting passage sidewardly to open the passage downwardly and is positioned in the predetermined position in the passage by a positioning device.

2 Claims, 5 Drawing Figures

COIN SORTING DEVICE

BACKGROUND OF THE INVENTION

1. Field of the Invention

The present invention relates to coin sorting devices.

2. Description of the Prior Art

In general, as described in Japanese patent application laid-open publication No. 157,085/1980, a coin sorting device includes a coin sorting passage adapted for running a coin or a token on a track between a stationary side plate and a movable side plate openably connected to and spaced to the stationary side plate. In Japanese patent application publication No. 16/527/1971 there is described a coin sorting device which comprises at least one set of transmitting and receiving coils positioned in alignment with each other at the opposite sides of the coin sorting passage, respectively, for detecting the load impedance of a coin passing between the transmitting and receiving coils to detect the type of material of the coin.

In the known coin sorting device of the type as mentioned above, the coin running track in the coin sorting passage is usually fixed to or integrally formed with the movable side plate hinged to the stationary side plate so that when a coin is stopped in the coin sorting passage due to the coin being deformed, distorted or non-acceptable because it has a diameter larger than that of an acceptable coin, the movable side plate must be moved away from the stationary side plate by operating a return lever or a push button to withdraw the coin running track from the coin sorting passage thereby opening it in a downward direction in order to allow the coin stopped therein to fall into a return chute.

Particularly, in the coin sorting device of the type as mentioned above which comprises a set of transmitting and receiving coils positioned at opposite sides of the coin sorting passage, respectively, so as to detect the load impedance of the coin passing therebetween, the tendency for the coin to stop increases as the sorting accuracy of the coin sorting device is increased. This is because the coils are arranged in predetermined positions corresponding to the specific portion of the coin, such as the peripheral edge or center and therefor the dimension in the vertical direction or the height of the coin sorting passage is restricted to a dimension slightly greater than the diameter of the acceptable coin. These restricted dimensions will prevent the coin from coming out of the predetermined course due to the coin jumping out of the track. Also the distance between the coils is restricted to a dimension slightly greater than the thickness of the acceptable coin to provide high sorting accuracy.

Accordingly, the prior coin sorting devices, discussed above, have serious disadvantages in that the distance between the coils is changed some times because the transmitting coil and the receiving coil are mounted on the stationary side plate and the movable side plate, respectively, so that when the movable side plate is frequently moved away from the stationary side plate to remove a stopped coin from the coin sorting passage between the coils a change in the distance between the coils results. The sorting accuracy of the coin sorting device of the type as mentioned above is greatly affected by changes in the distance between the coils, such that when the standard distance is set to 3.5 mm, a change from the standard distance of 0.25–0.75 mm will result in an impedance difference of 10%.

SUMMARY OF THE INVENTION

An object of the present invention is to provide an improved coin sorting device comprising a stationary retainer frame for mounting both of the detecting coils, the transmitting coil and the receiving coil, in a fixed relationship therebetween. In this way a predetermined distance between the coils and the track for running a coin through the coin sorting passage between said coils is maintained. Also, the coin sorting passage can be retracted to the side to downwardly open the passage so that a coin stopped in the passage between the coils will fall therefrom in order to remove the coin stopped therein. The invention also makes it possible to restrict the distance between the coils to a minimum dimension and to maintain it constantly.

BRIEF DESCRIPTION OF THE DRAWINGS

Referring to the accompanying drawings, which illustrate a preferred embodiment of the present invention, in which.

DESCRIPTION OF THE PREFERRED EMBODIMENTS

Figure 1:
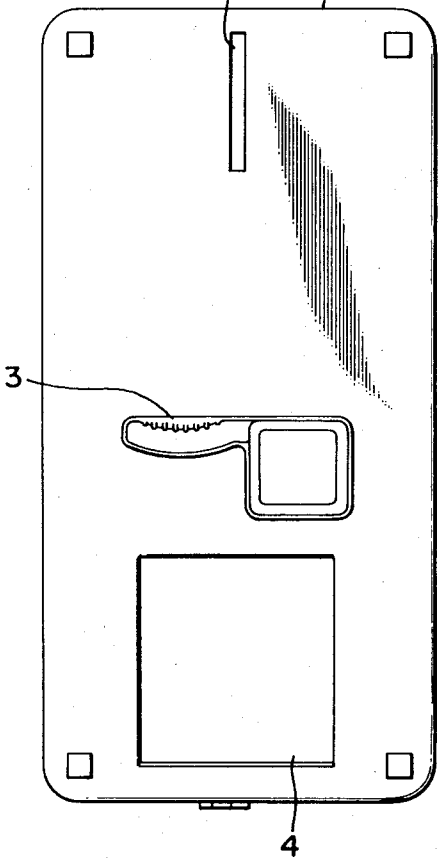
FIG. 1 is a front elevational view of the coin sorting device.
Figure 2:
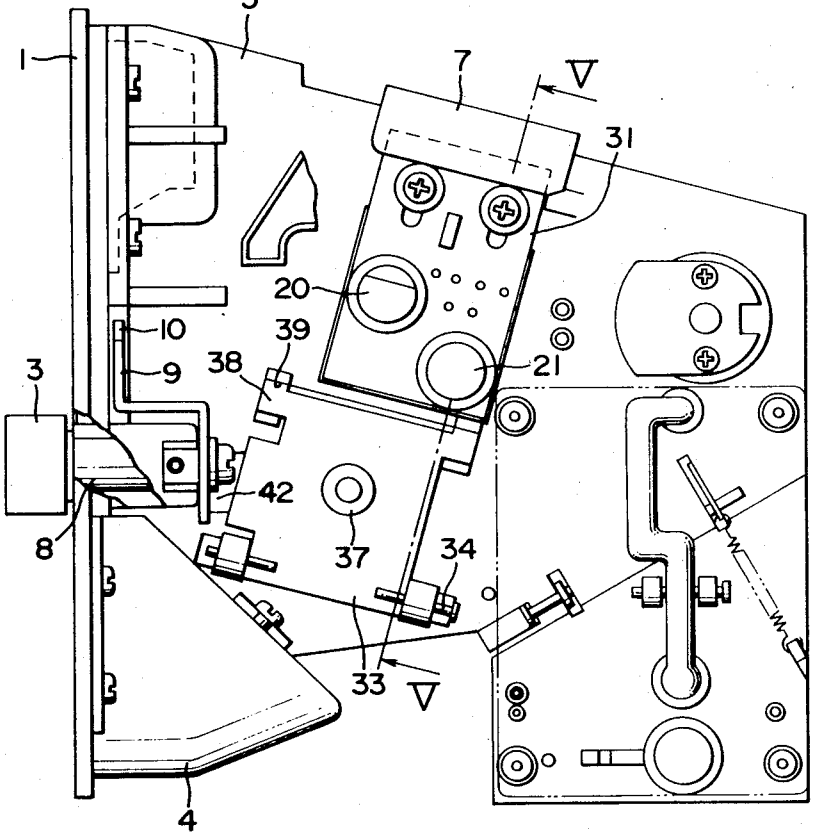
FIG. 2 is a right side elevational view of the coin sorting device of FIG. 1.
Figure 4:
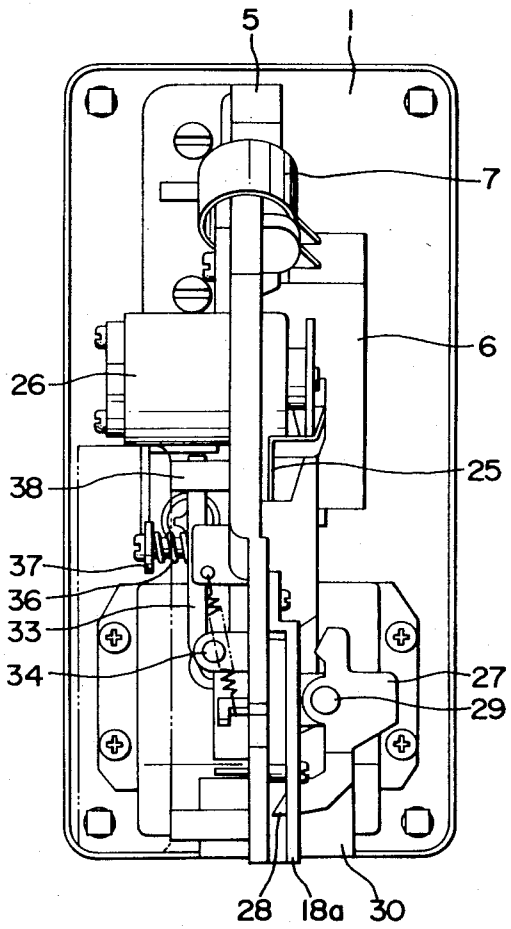
FIG. 4 is a rear elevational view of the coin sorting device of FIG. 1.

The present invention will be described with reference to the accompanying drawings.

In the drawings, the reference numeral 1 designates a front plate which includes an opening 2 in which a coin can be inserted, a returning lever 3 and a return opening 4. A stationary side plate 5 is fixed, at the front side thereof, to the back surface of the front plate 1 by means of bolts or the like. A movable side plate 6 is openably connected, at the upper side thereof, to the upper side of the stationary side plate by a hinge connector means 7. This arrangement allows plate 6 to be moved away from the stationary side plate to open the coin sorting passage 24 in a downward direction by the cooperation of a driven face 10 with a driving face shaped by an involute curve of a pusher plate 9 fixed to a shaft 8 of the returning lever 3 as described in Japanese patent application laid-open publication No. 157,085/1980 (corresponding to U.S. Pat. No. 4,376,480).

Figure 3:
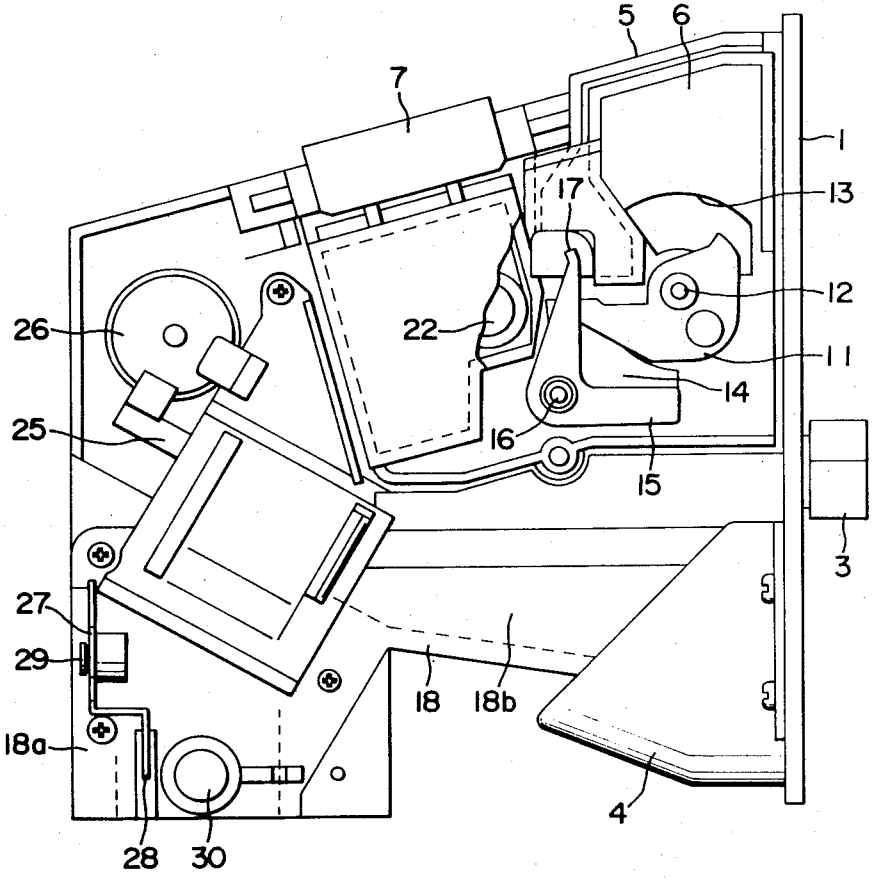
FIG. 3 is a left side elevational view of the coin sorting device of FIG. 1.

Referring to FIG. 3, a counter-balanced cradle 11 for sorting the diameter and weight of a coin is pivoted at a pin 12 to the movable side plate 6 and is provided with two engaging lugs which extend into the coin sorting passage 24 through openings 13 and 14, respectively, formed in the movable side plate 6. An engaging lever 15 is also pivoted at a pin 16 to the movable side plate 6 and has an engaging arm 17 extending from the upper end of the lever 15 into the coin sorting passage so as to prevent a coin inserted from the coin inserting opening 2 from engaging inadequately with the lugs of the cradle 11. A T-shaped stationary side plate having a vertical coin chute side plate portion 18*a* and a coin return chute side plate portion 18*b* is secured, at the same side of the movable side plate 6, to the stationary side plate 5 so as to define a coin chute and a return chute therebetween, respectively.

Two sets of transmitting coils 20 and 21 and receiving coils 22 and 23 for detecting the coin material as described in Japanese utility model application No. 117,667/1981 (Japanese utility model application laid-open publication No. 24,870/1983) are positioned at the opposite sides of the coin sorting passage 24. A deflecting gate plate 25 as described in Japanese utility model application No. 148,657/1981 (Japanese utility model application laid-open publication No. 54,768/1983) is arranged at the branching point in the coin passage for effecting the separation of acceptable coins from non-acceptable or spurious coins. A gate actuating means 26 energized as a result of the detection by means of the detecting coils directs coins to the coin chute or return chute, respectively. An anti-stringing lever 27 has an engaging end 28 protruding into the coin chute and pivoted at a pin 29 to the chute side plate 18*a* and the lower end of the chute side plate is provided with a coin counting sensor 30 at the outlet of chute.

A coin inserted into the coin sorting passage through the coin inserting opening 2 in the front plate 1 is sorted by its diameter and weight by the cradle 11 such that non-acceptable coins having smaller or larger diameters than that of an acceptable coin passes the cradle 11 between the lugs thereof to drop downwardly into the return chute or is retained on the cradle and stopped in the coin sorting passage. The coin rotated by and freed from the cradle 11 then rolls on the track to pass the coin sorting passage between the transmitting coil 20 and receiving coil 22 and then between the transmitting coil 21 and receiving coil 23 to be given a materials check. If the material of the coin is non-acceptable, the non-acceptable coin is deflected to the return chute by the deflecting gate plate 25. If the material of the coin is acceptable, the deflecting gate plate 25 is opened by the gate actuator 26 and the acceptable coin passes downwardly into the coin chute and out the coin chute through the outlet at the lower end thereof to fall into a convenient cash box after having been sensed by the counter sensor 30.

Figure 5:
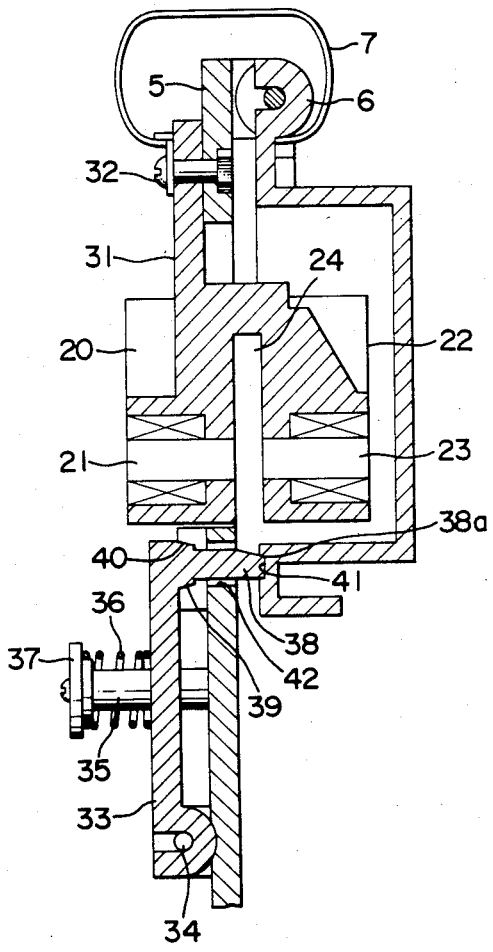
FIG. 5 is a sectional view taken along line V—V of FIG. 2.

Referring to FIG. 5, according to the present invention, at the opposite sides of the coin sorting passage, the transmitting coils 20 and 21 and the receiving coils 22 and 23 are opposedly fixed in a stationary retainer 31 in predetermined positions relative to the track 38. The retainer 31 is secured to the stationary side plate 5 in a fixed position by means of screws 32.

A movable track supporting plate 33 is hinged at the lower end thereof to the stationary side plate 5 by means of hinge pins 34. A support rod 35 fixed to the stationary side plate 5 is extended through an opening formed in the track supporting plate and has a compression spring 36 interposed between the track supporting plate 33 and a seat 37 fixed on the support rod 35 at the outer end thereof to urge the movable track supporting plate 33 against the stationary side plate. The movable track supporting plate 33 is provided with a track portion 38 which is extended laterally from the upper end of the plate 33. The track portion 38 is normally protruded through a slot 42 formed in the stationary side plate 5 into the lower portion of the coin sorting passage 24 between the transmitting coils 20, 21 and receiving coils 22, 23 by the urging action of the spring 36 and is positioned by fitting a tapered shoulder 39, formed in the track portion 38, into a tapered set 40 formed in the stationary side plate 5. For the purpose of providing additional positioning means, the track portion 38 is provided with a tapered outer end 38*a*, while the movable side plate 6 is provided with a recess 41 for receiving the tapered outer end to thereby position the movable track 38 in the predetermined position relative to the movable side plate 6.

The movable track supporting plate 33 is engaged with a pusher plate 42 on the shaft 8 of the returning lever 3 such that when the returning lever is operated, the pusher plate 42 pushes the movable track supporting plate 33 outwardly against the spring force to rotate it about the hinge pins 34 outwardly thereby to retracting the movable track 38 from the coin sorting passage 24 in a sideways direction. This allows the coin stopped in the coin sorting passage 24 to fall into the return chute, while the detector coils 20, 22 and 21, 23 are stationary thereby maintaining the predetermined distance therebetween and making it possible to provide high detecting accuracy.

What is claimed is:

1. A coin sorting device comprising:

a stationary side plate;

a movable side plate openably connected at the upper side thereof to and spaced sidewardly from said stationary side plate to define a coin sorting passage therebetween;

at least one set of transmitting and receiving coils positioned in alignment with each other at the opposite sides of the coin sorting passage, respectively, for detecting a load impedance of a coin;

a stationary retainer frame for mounting both of said transmitting coil and said receiving coil in fixed relation in order to maintain a predetermined distance between said coils; and a track for running a coin through said coin sorting passage between said coils which is adapted to retract sideways out of said coin sorting passage to downwardly open the passage so that a coin stopped in said passage between said coils falls therefrom to remove a coin stopped therein;

said track being provided on a track portion projecting laterally from the upper end of a plate member which is hinged at a lower end to said stationary side plate and is urged by means of a spring so as to extend said track portion through an opening in said stationary side plate to position said track in said coin sorting passage;

said track portion having a tapered shoulder, while said stationary side plate contains a seat for said tapered shoulder so as to position said track in said coin sorting passage.

2. A coin sorting device comprising:

a coin sorting passage defined between two side plates; said coin sorting passage having a bottom;

at least one set of transmitting and receiving coils being securely positioned in alignment with each other at the opposite sides of the coin sorting passage for detecting a load impedance of a coin passing in the coin sorting passage;

a coin running track on which a coin runs through said coin sorting passage in a portion between said coils, said coin running track having a tapered shoulder;

said coin running track being provided at the bottom of said coin sorting passage in a portion between said coils;

said coin running track being adapted to retract out of the bottom of said coin sorting passage in a sideways direction thereby forming an opening in the coin sorting passage in a downward direction whereby any coins held in said coin sorting passage will fall clearing said coin sorting passage; and one of said plates being stationary and said coin running track being retractably extendable into the coin sorting passage through an opening formed in said stationary plate, said stationary plate having a seat for said tapered shoulder whereby said coin running track is positioned in said coin sorting passage.

* * * * *